United States Patent [19]

Santilli

[11] Patent Number: 4,741,372

[45] Date of Patent: May 3, 1988

[54] POCKET ORGANIZER

[76] Inventor: Michael A. Santilli, 3528 Cotillion, Plano, Tex. 75074

[21] Appl. No.: 869,999

[22] Filed: Jun. 3, 1986

[51] Int. Cl.[4] ..... A45C 1/06; A45C 11/18

[52] U.S. Cl. ..... 150/137; 150/138; 150/145; 150/147; 150/148; 206/37; 206/38; 206/39

[58] Field of Search ..... 150/131, 132, 135, 137, 150/138, 140, 141, 145, 147–149; 206/38, 37, 39

[56] References Cited

U.S. PATENT DOCUMENTS

| | | | |
|---|---|---|---|
| 1,638,462 | 8/1927 | Ryan | 150/132 |
| 2,402,764 | 6/1946 | Miller | 150/133 |
| 2,422,432 | 6/1947 | Miller | 150/133 |
| 2,597,967 | 5/1952 | Anderson | 150/145 X |
| 2,718,911 | 9/1955 | Solomon | 150/138 X |
| 2,767,756 | 10/1956 | Niles | 206/39 |
| 2,802,502 | 8/1957 | Seamon | 150/137 |
| 3,018,532 | 1/1962 | Rinaldi | 150/149 X |
| 3,299,929 | 1/1967 | Shagin et al. | 150/138 X |
| 3,334,677 | 8/1967 | Toomey | 150/149 |
| 3,438,415 | 4/1969 | Burniski et al. | 150/145 X |
| 3,461,469 | 8/1969 | Morrison | 150/132 X |
| 3,548,907 | 12/1970 | Boldt | 150/148 X |
| 3,734,155 | 5/1973 | Stenger | 150/148 |
| 3,757,840 | 9/1973 | Herbener | 150/136 |
| 3,856,063 | 12/1974 | Dengel | 150/132 |
| 4,105,057 | 8/1978 | Baumann et al. | 150/132 |

FOREIGN PATENT DOCUMENTS

| | | | |
|---|---|---|---|
| 555838 | 4/1958 | Canada | 150/138 |
| 254123 | 7/1926 | United Kingdom | 150/132 |
| 819763 | 9/1959 | United Kingdom | 150/148 |

*Primary Examiner*—William Price
*Assistant Examiner*—Sue A. Weaver
*Attorney, Agent, or Firm*—Gifford, Groh, VanOphem, Sheridan, Sprinkle and Dolgorukov

[57] ABSTRACT

A pocket organizer comprising a cover sheet, at least one first open topped envelope having a medial seam defining two separate pocket compartments, and at least one second envelope dimensioned to be received in one of the pocket compartments of said first envelope. Preferably, a plurality of first envelopes are releasably secured together by a resilient clip and one of the first envelopes is secured along the lateral edge to one end of the cover sheet. Preferably, the cover sheet and each of the first and second envelopes is formed of a clear plastic material so that the contents of each compartment and envelope can be readily identified. In addition, each envelope can be provided with a flexible tag secured to extend outwardly from the edge of each envelope and including alphabetic indicia to represent the type of contents desired in each compartment.

15 Claims, 1 Drawing Sheet

POCKET ORGANIZER

BACKGROUND OF THE INVENTION

I. Field of the Present Invention

The present invention relates generally to article holding receptacles, and more particularly to wallet type receptacles having compartments adapted to receive credit cards, identification cards, paper money and the like.

II. Description of the Prior Art

There are many previously known types of wallets and billfolds which keep such items in an orderly, compact arrangement while carried within a clothing pocket. While leather is a popular material for making such pocket organizers, such panels used to form the organizer must often be stitched or sewn together in order to form an organizing pocket. As a result, a substantial amount of time and labor is necessary to construct such a wallet. Moreover, such constructions can increase the bulk and breadth of the wallet or, conversely, restrict the size of the compartments in the wallet. Moreover, the items stored in the pockets formed from such materials cannot be identified unless they are individually removed from the pockets.

Although it has been previously known to provide transparent compartments in a wallet, those compartments are often separately insertable, and not integrally constructed with the pocket organizer and thus also tend to increase the bulk of the wallet. Moreover, many of the previously known compartments are adapted for receiving only a single card or flat item and thus are not well adapted for storing a plurality of different or related items such as credit cards. Moreover, each compartment must be examined in order to locate a desired item stored in the wallet.

SUMMARY OF THE PRESENT INVENTION

The present invention overcomes all of the above mentioned disadvantages by providing a pocket organizer comprising an elongated cover sheet, at least one first envelope defining at least one, and preferably two, pocket compartments, and at least one second envelope adapted to be received in a compartment of the first envelope. The cover sheet is longer than the length of the first envelope so that when the first envelope is folded to form two compartments, the cover sheet can be wrapped around the envelope, whereby a portion of the sheet overlaps itself and retains the pocket organizer in a closed position. Preferably, the envelopes are made of a transparent material for ready identification of contents. Alternatively, some of the envelopes may be opaque to afford a degree of privacy.

In the preferred embodiment, a plurality of first envelopes are releasably secured together by a resilient clip. At least a portion of the clip is resiliently retained against the side of an envelope to retain paper money between the side and the clip. All of the envelopes are flexible so that they can be folded where desired, although preferably, each first envelope is heat sealed along a median line to form two pocket compartments in each envelope. As a result, the second envelope is appropriately sized to be received in one of the pocket compartments of a first envelope. Preferably, each pocket compartment of a first envelope is provided with a label in the form of a tag extending outwardly from the edge of the envelope so that an indication of the contents in that envelope can be identified by appropriate indicia without removal of the contents from the compartment or without examination of each pocket to locate the desired article.

Thus, the present invention provides a simple and efficient pocket organizer which is substantially less bulky than previously known pocket organizers. In addition, the pocket organizer provides a means for easily identifying the contents in each pocket compartment, and permits inspection of the documents contained within each envelope without removal of the documents from the envelope. Furthermore, the organizer can be provided with any number of envelopes and thus, compartments as desired. In addition, the overlapping portion of the outer sheet avoids the need for discrete fastening devices which can increase the bulk and form irregular bulges in previously known pocket organizers. In addition, the organizer provides easy access to and visible inspection of the contents of the envelopes without requiring removal of the contents from the pockets or requiring examination of each pocket until the desired articles are located. Nevertheless, the organizer is adapted to receive a wide variety of cards and paper which are typically carried by previously known pocket organizers.

BRIEF DESCRIPTION OF THE DRAWING

The present invention will be more clearly understood from the following detailed description of a preferred embodiment when read in conjunction with the accompanying drawing in which like reference characters refer to like parts throughout the views and in which.

DETAILED DESCRIPTION OF A PREFERRED EMBODIMENT OF THE PRESENT INVENTION

Figure 1:
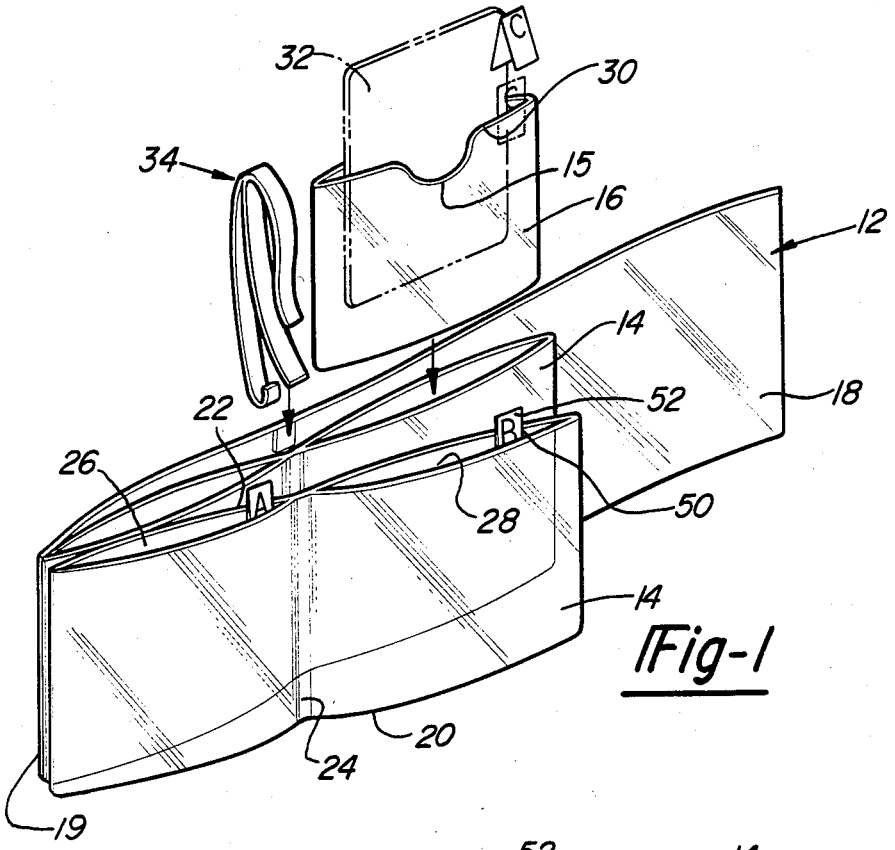
FIG. 1 is a perspective view of a pocket organizer according to the present invention.

Referring first to FIG. 1, a pocket organizer 10 according to the present invention is thereshown comprising a cover sheet 12, at least one, but preferably a plurality of envelopes 14, (two shown) and at least, one but preferably a plurality of second envelope members 16 (one shown). The sheet 12 and each of the envelopes 14 and 16 is made of a clear flexible plastic. However, it is to be understood that although a wide variety of materials can be used in forming the cover sheet 12, the first envelopes 14 and the second envelopes 16, it is preferable that at least the first envelopes 14 and second envelopes 16 are made of a substantially transparent material. Alternatively, the first envelopes 14 or the second envelopes 16 may be made of opaque materials to afford some concealment of the contents. In any event, it will be understood that the present invention also provides a means for identifying the contents of the envelopes without individual observation of the contents through the envelopes by the labelling attachments to be discussed in greater detail hereinafter.

In the preferred embodiment, the cover sheet 12 comprises a sheet of clear, polyurethane plastic which is longer than the envelopes 14 so that an end portion 18 of the sheet 12 can be wrapped around the envelopes 14 and overlap the other end of the sheet. Surface tension between the overlapping end portion 18 and the other end of the sheet thereby eliminates the need for discrete fastening devices such as the snaps often used in previously known pocket organizers to secure the organizer in a closed position. Adherence of the overlapping end 18 to the other end of the sheet 12 can be enhanced by stretching the overlapping portion 18 as it is laid against the other end of the sheet 12.

Each envelope 14 comprises a similar polyeurethane sheet forming an open topped envelope. For example, a sheet substantially twice the width of the cover sheet 12 can be folded upon itself to form a closed bottom 20 and an open top 22. The lateral edges of the envelope 14 are closed by heat sealing or the like to close the lateral edges of the pocket formed therein. Preferably, the sides of the envelope are also heat sealed together along the center of the envelope 14 to form a seam as shown at 24 in FIG. 1. Thus, each envelope 14 forms two pocket compartments 26 and 28 respectively. Any desired number of envelopes 14 can be joined together along the heat seal seam 24 by means of a resilient clip 34 to be discussed in greater detail hereinafter.

Figure 4:
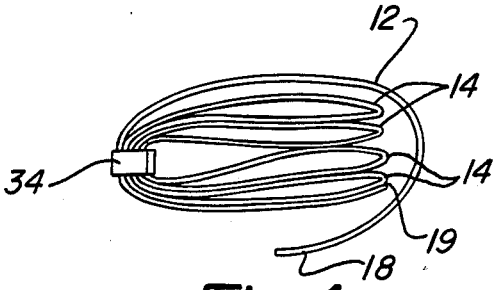
FIG. 4 is a top view of the organizer shown in a partially closed position.

Each second envelope 16 can also be formed of a similar polyeurethane material and forms an open topped compartment 30. The pocket compartment 30 is dimensioned to receive articles such as the credit card 32 shown in phantom line in FIG. 1 and preferably, is dimensioned to correspond with the size and shape of the card. Moreover, each second envelope 16 is dimensioned to be slidably received within a compartment 26 or 28 in a first envelope 14, and each second envelope 16 contains a notch 15 in its top edge to facilitate removal of flat contents. Thus, while each pocket compartment 26 and 28 must be slightly larger than the size of each article 32, it will be understood that the length of the first envelope 14, and thus the overall length of the entire pocket organizer can be minimized by dimensioning the compartments substantially to correspond with the size of the articles 32. Moreover, the cards preferably are positioned lengthwise to minimize the width of the folded organizer as shown in FIG. 4.

Figure 2:
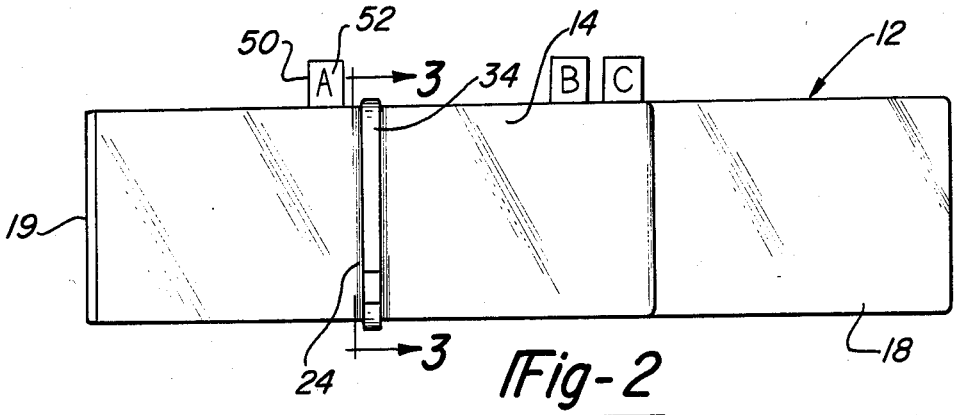
FIG. 2 is a front view showing the organizer shown in FIG. 1 in an open position.

As best shown in FIG. 2, the cover 12, each first envelope 14 and each second envelope 16 has substantially the same height. Of course, it is to be understood that variations in the height of each of these elements can be made so long as each second envelope 16 is dimensioned to be insertable within the compartments 26 and 28 of the first envelopes 14. The lateral edge 19 of the cover 12 is secured, by heat sealing or the like, to the lateral edge of the first envelope to secure the cover sheet 12 in a fixed position with respect to a portion of the pocket organizer 10. Preferably, only one envelope 14 is secured at its lateral edge to the edge 19 of the cover 12 and the remaining envelopes 14 are secured together along the center seam 24 by a clip 34.

Figure 3:
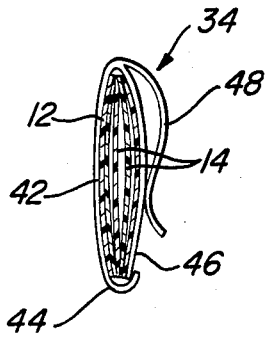
FIG. 3 is a sectional view taken substantially along line 3—3 in FIG. 2.

Referring now to FIG. 3, the preferred embodiment of the device is shown in side cross section. A clip 34 positively retains the envelopes 14 in a fixed position with respect to each other, and comprises a base leg 42 having a C shaped end portion 44 and a return bent leg portion 46 adapted to be resiliency retained beneath the end of the C shaped portion 44. In addition, a resiliently biased prong 48 presses against the bent leg 46 so that additional articles such as paper currency can be retained within the confines of the pocket organizer 10. Preferably, the clip is substantially as narrow as the seam 24 so that, as shown in FIG. 4, the wallet can be folded flat and the end portion 18 of the cover sheet 12 is tightly overlapped upon the other end portion of the cover sheet 12.

Referring again to FIG. 1, each envelope 16 is shown having a flexible tab 50 secured at a top edge so as to extend outwardly beyond the ends of each pocket compartment 26 and 28. Each flexible tab 50 is secured by heat seals, adhesives or the like and include indicia 52 such as alphabetic characters which identify a particular type of article to be retained within the compartment. Of course, the position of each tab 50 along the top edge of each envelope 16 is varied so that the tabs do not overlap each other and remain visible without separation of the individual envelopes 14. In addition, the tabs 50 may be used to pull the second envelope 16 and its contents out of the compartments 26, 28. Nevertheless, the flexible tabs 50 permit tight wrapping of the cover 12 around the envelopes 14 without substantially increasing the breadth of the folded pocket organizer.

Thus, the present invention provides a pocket organizer in which the contents of individual compartments can be readily identified by mere observation of the envelope forming pockets. Moreover, the outwardly extending identification tabs permit ready identification of a particular type of article to be stored in the organizer regardless of the particular material used to construct the organizer. Moreover, it will be understood that the pocket organizer according to the present invention minimizes the bulk and breadth necessary to store desired articles often carried in pocket. Moreover, the organizer is lightweight and avoids the need for complicated stitching and snap fasteners which can substantially increase the bulk and cost of manufacturing the organizer. Nevertheless, the organizer conveniently organizes a wide variety of articles for ready identification and removal in a minimum of space.

Having thus described the present invention, many modifications thereto will become apparent to those skilled in the art to which it pertains without departing from the scope and spirit of the present invention as defined in the appended claims.

What is claimed is:

1. A pocket organizer comprising a substantially rectangular sheet at least one first open-topped envelope having transverse edges adjacent its open top, means for medially folding each said first envelope parallel to its transverse edges to form first and second open topped envelope compartments, at least one second open-topped envelope dimensioned to be slidably received in one of said first and second compartments, wherein said sheet includes a transverse edge having a length substantially the same as the length of a transverse edge of one of said first envelopes, means for securing said transverse edge of said sheet to said transverse edge of at least one of said at least one first envelope, wherein said rectangular sheet is longer than said at least one first envelope, whereby a portion of said sheet overlaps said sheet when said sheet is wrapped about each said at least one medially folded first envelope.

2. The invention as defined in claim 1 and further comprising means for retaining said overlapping portion on said sheet to close said pocket organizer.

3. The invention as defined in claim 2 wherein said sheet is made of a flexible synthetic material and wherein said means for retaining comprises the surface tension of said overlapping portion as said portion is stretched and engaged against said sheet.

4. The invention as defined in claim 1 wherein said sheet and each said first and second envelope is made of a substantially opaque material.

5. The invention as defined in claim 1 wherein said sheet and each said first and second envelope is made of a substantially transparent material.

6. The invention as defined in claim 1 wherein said means for medially folding comprises a heat seal seam extending along and joining opposite sides of each said first envelope.

7. The invention as defined in claim 6 wherein said at least one first envelope comprises at least two first envelopes and further comprising means for removably connecting said at least two envelopes together at said heat seal.

8. The invention as defined in claim 7 wherein said means for connecting comprises an elongated spring clip extending along said heat seal seam.

9. The invention as defined in claim 8 wherein said spring clip comprises a base, a prong and means for resiliently biasing said prong toward said base.

10. The invention as defined in claim 8 wherein said spring clip comprises a base, a prong, means for connecting one end of said prong to one end of said base, and means for selectively locking the other end of said prong to the other end of said base.

11. The invention as defined in claim 10 and further comprising a second prong, and means for resiliently urging said second prong toward one of said first prong and said base.

12. The invention as defined in claim 1 and further comprising money clip means for resiliently engaging paper money against a side of one of said at least one first envelope.

13. The invention as defined in claim 1 and further comprising a plurality of first envelopes, and wherein each envelope includes indicia means for designating a particular type of article to be inserted in said first and second compartments.

14. The invention as defined in claim 13 wherein each said indicia means comprises an alphabetic character.

15. The invention as defined in claim 13 wherein said indicia means comprises a label, and means for securing said label to said first envelope so that at least a portion of said label extends outwardly beyond a peripheral edge of said first envelope.

* * * * *

UNITED STATES PATENT AND TRADEMARK OFFICE

CERTIFICATE OF CORRECTION

PATENT NO. : 4,741,372

DATED : May 3, 1988

INVENTOR(S) : Michael A. Santilli

It is certified that error appears in the above-identified patent and that said Letters Patent is hereby corrected as shown below:

Col. 3, line 1 after "sheet", insert --12--;

line 3 after "sheet", insert --12--;

line 38 after "organizer", insert --10--;

line 51 after "envelope", insert --14--;

line 62, delete "resiliency" and insert --resiliently--;

line 67 after "clip", insert --34--;

Col. 4, line 12 after "tabs", insert --50--.

Signed and Sealed this

Thirteenth Day of September, 1988

*Attest:*

DONALD J. QUIGG

*Attesting Officer*

*Commissioner of Patents and Trademarks*